US005396844A

United States Patent [19]

Hessey

[11] Patent Number: 5,396,844

[45] Date of Patent: Mar. 14, 1995

[54] AMMUNITION FOR SIMULATED FIREARM

[76] Inventor: B. Russell Hessey, 5304 Mohave Dr., Simi Valley, Calif. 93063

[21] Appl. No.: 93,392

[22] Filed: Jul. 19, 1993

Related U.S. Application Data

[63] Continuation-in-part of Ser. No. 880,893, May 8, 1992, Pat. No. 5,233,776.

[51] Int. Cl.[6] ..... F42B 4/18

[52] U.S. Cl. ..... 102/355; 102/202.9

[58] Field of Search ..... 102/202.7, 202.9, 202.11, 102/281, 355, 356, 360, 466, 472, 530

[56] References Cited

U.S. PATENT DOCUMENTS 3,354,571 11/1967 Parker ..... 42/54
3,695,179 10/1972 Rainone et al. ..... 102/202.11
4,245,403 1/1981 Hipp ..... 102/355

OTHER PUBLICATIONS

Military Explosives, TM 9-1910, TO 11A-1-34, Apr. 1955, pp. 284-290.

Brady, George S., Materials Handbook, 1956, pp. 782-783.

*Primary Examiner*—Stephen C. Bentley
*Attorney, Agent, or Firm*—Quirk & Tratos

[57] ABSTRACT

Ammunition for an electronically activated simulated firearm includes a combustible powder contained in a plastic casing having electrically conductive pins which mount in a barrel portion of the firearm. The powder charge is less than 2 grains of an oxidizer, a fuel, and a color enhancer to provide the smoke and flash of a real weapon without producing any significant noise or creating danger.

30 Claims, 5 Drawing Sheets

AMMUNITION FOR SIMULATED FIREARM

RELATIONSHIP TO OTHER CASES

This application is a continuation-in-part of application Ser. No. 07/880,893, filed May 8, 1992, now U.S. Pat. No. 5,233,776.

FIELD OF THE INVENTION

This invention relates to "ammunition" or loads for a simulated gun for use in the movie and entertainment industry or for police training which "fires" a shot which is substantially noiseless and safe at very close distances. More particularly, the invention comprises an electronically actuated simulated combustible loads for weapons which provide smoke and a flash, but which are harmless, and which comprise a pair of conductive mounting pins connected to an internal bridge wire, and a casing containing about 1 grain or less of a combustible powder mix.

BACKGROUND OF THE INVENTION

The entertainment industry has many uses for simulated guns, not only in the movie industry but also in theatrical performances, amusement parks, and the like. In each case, the intention is to produce simulated gunfire that appears realistic. Obviously, however, although the appearance of a flash and smoke from a barrel and possibly a loud report may be desirable, it is absolutely essential that actors working with these firearms not be injured. In some cases, particularly in the movie industry, specific shapes or profiles of guns are designed to be unlike any existing firearm. For example, in the movie "Robocop" a specific machine gun was designed for the title character to fit a futuristic plot. In other cases, the gun profiles are designed to be exact replicas of existing real firearms, thus adding reality to the scene. In fact, in many cases actual firearms are used but are equipped with blank cartridges which fire with a loud report but are supposedly harmless. In fact, however, blank cartridges fired from conventional firearms are quite dangerous at close range and have actually resulted in serious injuries to actors.

When untrained actors use real guns, they often mishandle the guns and also often miscue by firing at the wrong instant, despite the fact that the guns are loaded with blanks. In addition, pistols loaded with blanks frequently malfunction. It is not uncommon for the mechanisms that cycle brass cartridges into the firing chamber to jam because the blank cartridges are too light and do not follow the channels properly. In making a motion picture, the jamming of a gun, whether it be a pistol or a machine gun, will completely ruin a scene. Scenes are often shot several times simply because a blank gun does not fire properly.

While reducing the size of the charge in the blank cartridge may frequently cause jamming of the firearm, in some cases adequate reductions in the amount of the charge cannot be made because of functional requirements of the weapon. For example, for machine guns and semi-automatic firearms an adequate charge is required to build up approximately 18,000 psi in the barrel of the firearm in order to eject the spent cartridge and inject a new one. Coupled with the charge size, these firearms must have a very small orifice to enable this pressure to build and unlock this ejection/feed mechanism. Thus, the use of real firearms to shoot blank cartridges for the entertainment industry is neither effective nor functional.

The noise produced by firing blank cartridges also creates a problem in the entertainment industry. In most major cities, noise pollution regulations require that a weapon producing more than 80 decibels of sound cannot be fired after 10:00 p.m. New York City precludes the use of any real weapons under such circumstances. In addition, the Federal Firearms Control Act requires that a person who uses a real weapon be licensed, and also requires 24-hour security. Should film makers wish to include a shot inside a government building or state capitol building, the use of any type of real weapon is precluded. Indeed, film makers have been obligated to reproduce an entire capitol building in order to film scenes involving firearms so as to comply with the laws and not frighten members of the public.

In virtually all cases of movie making, much of the scenes involving firearms are created by editors. Despite the fact that the blank guns produce a loud report, the actual sound from the gun is never used on the film. All sounds of gunshots are added in the studio, because the sound emanating on the set does not produce the desired effect, gets in the way of the dialogue, and is distorted by the microphones. Thus, the actual sound is edited out and replaced by more suitable sound effects.

The electronic gun simulator of the invention also facilitates production of simulated bullet hits. At present, if a scene showed gun hits impacting a wall, the bullet hits are produced by wiring charges behind the wall which are then fired sequentially to create an appearance of bullets impacting the wall. The gun firing is photographed separately. Film editors then cut back and forth between the bullet hits and the gun to create an appearance that the bullet hits are caused by the gun firing. This is a time-consuming and costly process. By using the electronic gun of the invention, the bullet hits and the gun can actually be controlled from the same source. For example, both the prewired bullet hits on the wall and the gun can be controlled either by the gun (by hard-wiring the gun to the bullet hit such that an impulse created by the gun also actuates the bullet hit) or from a remote radio-controlled source. No editing would be required to achieve this effect.

Because the simulated gun of the invention is not a weapon, it does not come within any local, state, or federal laws concerning firearms. Because the noise produced by the simulated gun is virtually inaudible past about 15 feet, no problems exist with respect to noise pollution regulations. Because there are no essential moving parts to the gun, no possibilities of a mechanical jam which would necessitate refilming exist.

The simulated firearm of the invention is not limited to use in the entertainment industry. A substantial demand exists for simulated weapons of this type in military, police, and security personnel training. The combustible loads or ammunition of the invention must meet a number of criteria for successful operation of the simulated weapons. The loads must produce a flash and smoke adequate to provide the appearance of a real weapon, yet preferably produce little sound. The loads are preferably made from a thin, plastic casing to avoid the possibility of injury from metal shrapnel. The combustible portion of the load should be free from poisonous, noxious or dangerous material. The plug which retains the combustible powder in the load must be light and harmless, thereby precluding any danger whatsoever from impact of the plug on a person or animal situated close to the muzzle.

Accordingly, it is an object of the present invention to provide ammunition for a simulated weapon which produces a visible flash and smoke but which produces relatively little noise. It is a further object of the invention to provide ammunition for a simulated gun which is electronically actuated and which produces a harmless discharge even when fired at close range. These and other objects of the invention are achieved by the simulated weapon described herein.

SUMMARY OF THE INVENTION

Ammunition for an electronically actuated simulated firearm produces visible "gunfire" which includes an explosive flash and smoke which is generally harmless and has a low noise level. Each load or squib comprises an elongate housing and a pair of mounting pins for mounting in a socket in the firearm. The mounting pins are connected electronically to a bridge resistance wire inside the load. Each load contains a small amount of explosive powder and a flash-producing additive such as aluminum powder. The housing is enclosed with a soft wad or plug which keeps the powder in place. The loads are mounted in one or more sockets and are set off sequentially responsive to a trigger by an electronic system mounted in the firearm.

BRIEF DESCRIPTION OF THE DRAWINGS

The invention is best understood with reference to drawings, in which.

DESCRIPTION OF PREFERRED EMBODIMENTS

Figure 1:
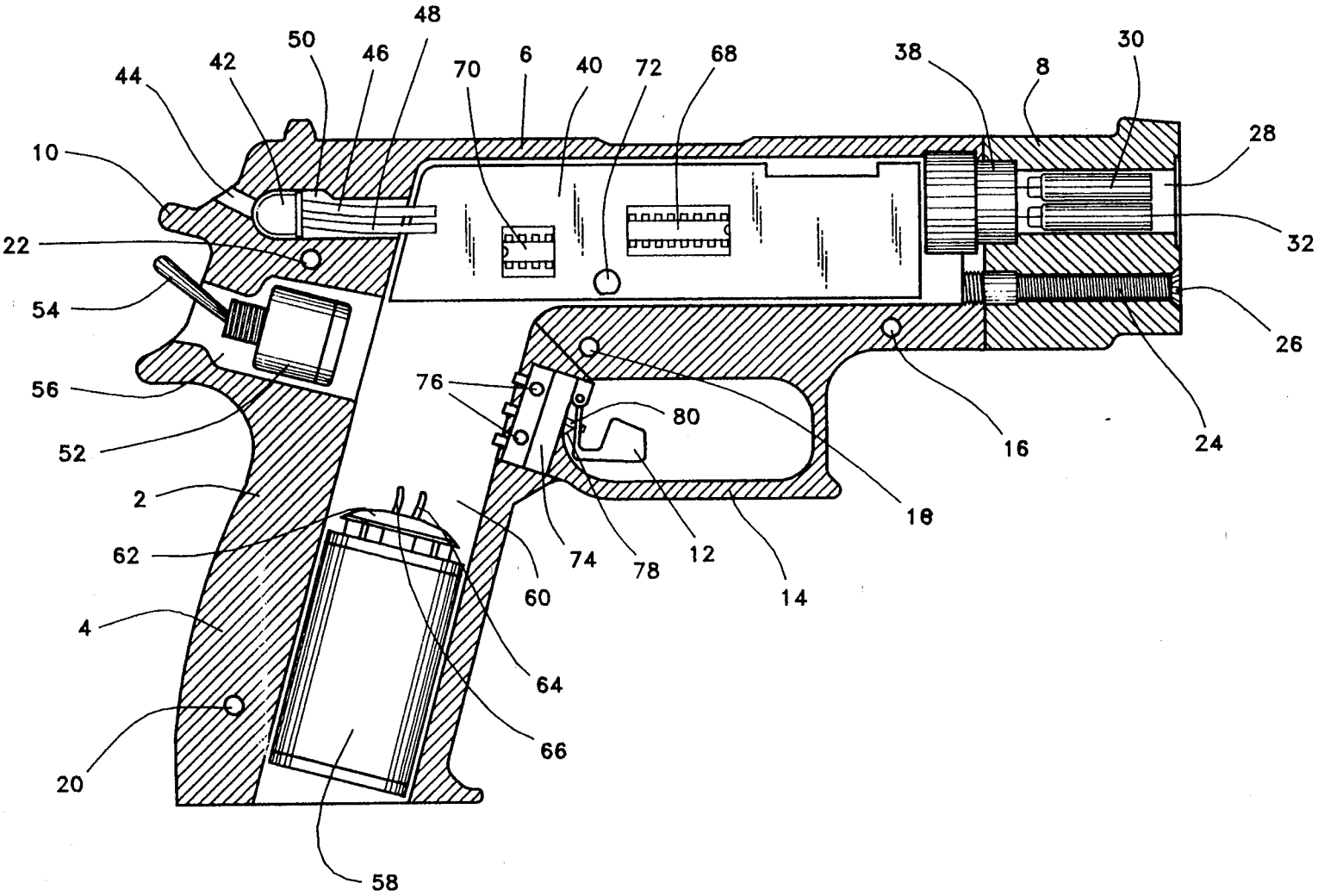
FIG. 1 is a side section view of a simulated handgun of the invention.

Referring first to FIG. 1, the operating mechanism for the simulated gun of the invention is enclosed entirely within the housing or casing 2. The housing may be metal or molded plastic, and may be of any desired shape. Typically, the housing may be fabricated to resemble a well-known gun to impart realism to a film. As with a standard pistol, the housing has a grip portion 4, a barrel 6, and a muzzle 8. While the housing generally may be a one or two piece molded casing, the muzzle is separately removable to enable mounting of the squibs or loads as hereinafter described. The housing has a simulated cocking mechanism 10 which, in the example shown, is simply a molded portion of the housing and is neither movable nor functional. The housing also has a trigger 12 which is used to actuate the gun and which is protected by a trigger guard 14.

The pistol shown in FIG. 1 has a housing molded in two interlocking sections; the cover section (not shown) is simply an exterior housing portion which mounts by means of screws to a series of threaded holes 16, 18, 20, and 22. These screws are removed to enable access to the hollow interior of the pistol which carries the electronic components of the invention. The muzzle portion 8 of the gun is attached to the body portion of the housing by means of a screw 24 having a head 26 countersunk into the front surface of the muzzle.

Squibs or loads 30, 32, 34 and 36 (see also FIG. 2) are mounted in axially spaced parallel orientation in an axial bore or conduit 28 in the muzzle. The squibs are mounted by means of legs or pins which extend into a socket or base which is mounted in the forward portion of the housing and has a cylindrical lug portion which extends axially into the bore 28. The mounting of the squibs is shown in more detail in FIG. 4.

The pistol is operated by means of electronic components mounted within the housing. The electronics are conventional and are designed simply to provide an adequate electrical charge to the pins of each squib sequentially to explode the charge on actuation of the trigger. A circuit diagram for the electronics of the pistol shown in FIG. 1 is set forth in FIG. 2. The electronic components, most of which are not shown in FIG. 1, are mounted on circuit board 40 located in the barrel portion of the pistol, which is hollow. The electronics are powered by a standard 9-volt battery 58 mounted in cavity 60 in the grip portion of the gun. The battery is wired through connector cap 62 and wire leads 64 and 66 to the circuit board; the wires have been omitted from FIG. 1 for clarity.

The battery is connected to the circuitry through toggle switch 52 which is mounted in switch cavity 56 in the rear portion of the pistol. The toggle switch is actuated through movement of switch handle 54 which is used simply to turn the power on and off. A red LED 72, which is visible through a small opening in the side of the casing cover (not shown), indicates to the user that the toggle switch is in the "on" position and that the pistol is powered.

A second LED, preferably green, is mounted in a cavity 50 at a rear portion of the gun and is visible through a channel 44 located just above the simulated hammer. The LED is connected to the circuit board via insulated leads 46 and 48 as shown in FIG. 1. The green LED indicates to the operator that the decade counter 68 is on zero. Thus, an operator will know not to insert or remove pins unless the power is off or the green light is on.

The timer 70, which is Motorola Part No. LM555, is mounted on the circuit board and sends a clock pulse to the counter responsive to the operation of the trigger. The counter 68, which is Motorola LM4017, acts as a sequencing means to direct the pulses sequentially to fire the various loads. The counter steps to the next output pin each time a pulse is received and then resets to zero after all shots have been fired.

The trigger 12 is the actuating arm for microswitch 74 which is attached to the housing by means of mounting screws 76. The trigger is maintained in an extended position by a leaf spring 78. An L-shaped catch 80 extends over the forward portion of the trigger to limit its forward movement.

Figure 2:
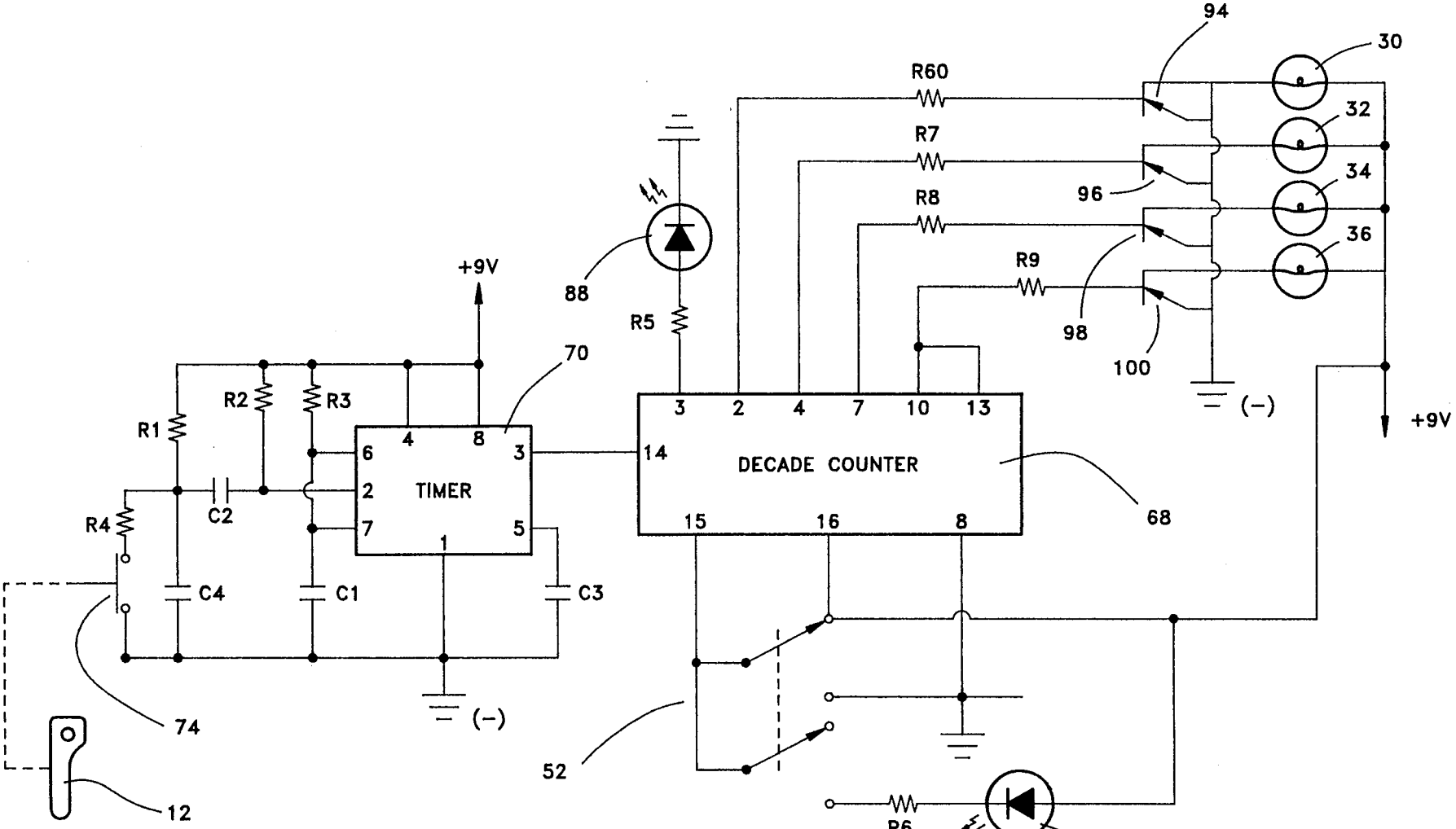
FIG. 2 is a schematic diagram of the electronics of the simulated handgun shown in FIG. 1.

A circuit diagram for the electronics for pistol 2 is shown in FIG. 2. Toggle switch 52 is a double-pole, double-throw switch shown in the "off" position. Actuating the switch connects LED 72 through to ground and charges pin 8 of the decade counter. Pressing trigger 12 closes NO microswitch 74, which sends one square wave pulse from the timer to the decade counter 68, I.C. 4017. The circuit is designed such that only one shot is fired each time the trigger is pulled. The counter, which is reset by actuation of the toggle switch, then indexes from the 3 pin (which is the zero position) to the 2 pin (the number 1 firing position), which sends an amplified square wave pulse to gate on the first Darlington amplifier 94. When the trigger is pressed the second time, the system repeats with an amplified square wave pulse being sent to the second Darlington amplifier 96, thus firing squib 32. Each time the trigger is pressed, the system repeats until all of the loads are spent.

The amplifiers 94, 96, 98 and 100 are NPN JE-800 Motorola 8 amp Darlington amplifiers. These are individual high-gain amplifiers using a Darlington pair to provide direct-coupled transistor stages. The two transistors are directly connected with the amplified output of the first being further amplified by the second; this coupling provides a 3.5 amp pulse to the load.

The component values are as follows: Capacitors $C_1$, $C_2$, $C_3$, $C_4$ are all 0.001 $\mu$f; $R_1$ and $R_3$=1 megohm; $R_2$=10 megohms; $R_5$ and $R_6$=200 ohms; $R_{60}$, $R_7$, $R_8$ and $R_9$=2K ohms, and $R_4$=1000 ohms.

Figure 5:
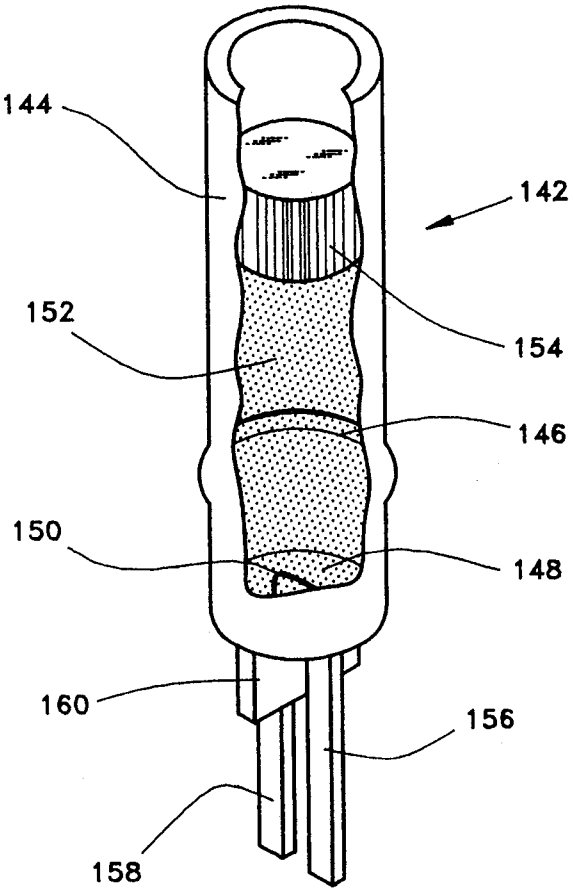
FIG. 5 is a cutaway view of a squib.

The squibs or loads 30, 32, 34 and 36 are shown in detail in FIG. 5. The construction of the squibs is one of the most important parts of the invention. Each squib or load comprises a plastic sleeve preferably PVC, which may be Cole Flex P-105-5 black non-shrink vinyl tubing. The tubing segment is approximately 1" long, and ¼" outside diameter with a sleeve wall thickness less than approximately 1/32", preferably about 1/64"–1/32". The sleeve as shown is mounted over a cylindrical molded plastic base 146 which is JKL Components part no. 183.

The squib has a pair of brass pins or terminals 156 and 158 which extend axially from the base and mount in the socket 38 of the gun. The terminals are connected to a bridge of nichrome resistance wire 150, 0.0034" in diameter, or other similar detonating wire which extends across the floor 148 of the plastic base. Alternatively, a detonating wire of 90% platinum/10% tungsten, 0.0025" in diameter, has been used successfully. An insulating tab 160 extends between the terminals. The sleeve may be rigid or semi-rigid, and may be made from plastic, fiberglass, or any material having sufficient strength to channel the explosion of the powder out the front of the sleeve. While the sleeve can be made of metal, this is less desirable because the metal could be ejected from the barrel causing harm to those in close proximity. The sleeve may be of any cross-sectional shape, e.g., round, square, rectangular or oval. In mass production, preferably the entire squib can be premolded with the sleeve and base being a single integral piece.

An explosive powder charge 152 lays on top of the resistance wire. Since a primer is not necessary, noxious and dangerous materials are eliminated from the load. The preferred powder is a finely divided mixture of an oxidizer, a fuel, and a color enhancer which has been ground to dust and passed through a 200 mesh screen. While any explosive material may be used for the charge, providing that it supplies the desired flash and puff of smoke, the preferred blend comprises from about 35% to about 55% vol, preferably about 40–45%, of magnesium, from about 5 to about 15% vol of sodium oxalate, with the balance (but preferably not over 50% vol) being potassium perchlorate. This mixture provides a highly visible yellow flash with a relatively small amount of smoke; this is desirable for most film-making applications because smoke tends to obscure the actor's face. Conventional gunpowder could also be used as the fuel, and indeed commercially available photoflash powder mixture can be used as a charge. Mixtures of gunpowder with a small amount of aluminum (to provide a visible flash) have also been used. The sodium oxalate color enhancer provides a brilliant yellow flash which photographs well; color enhancers are well-known in the art and can be selected depending on desired effect.

Since the squibs of the invention are not housed within a conventional gun, they need not be of any particular size or shape. The squibs usually are from about 0.5"–1.5" in length, and from 0.15"–0.4" outside diameter, and from 0.1–0.3" inside diameter. Squib casings having a relatively large length to outside cross-sectional area (e.g. in the range from about 15 to about 40 in./sq. in.) are preferred, because conventional gun barrels have relatively small diameters and in the present case, the squibs are mounted in the barrel portion of the gun. While in the pistol shown in FIG. 1 four squibs are mounted in the muzzle, anywhere from 6–8 squibs could be mounted in a pistol, and from 10–50 or more could be mounted in a machine gun. Thus, the choice of a long, narrow squib is generally dictated by the size and shape of the cavity in which the squibs are mounted. While as few as one or two squibs can be mounted in a muzzle, usually the gun would be designed to hold at least four squibs. Thus, the cross-section of a squib or load is substantially smaller than the cross-section of the muzzle opening. No mechanical movement of squibs or any other parts (with the possible exception of the trigger) are required to shoot all of the loads in the gun of the invention.

A very soft wad or plug 154 is used to maintain the powder in place. A small piece of cotton, fabric, or a foamed plastic, such as "STYROFOAM" foamed plastic, disk fits tightly inside the sleeve, but does not offer any resistance when the load is fired. A cylindrical "STYROFOAM" foamed plastic pad having a thickness of about 3/16" and a diameter of about 7/32" has been used successfully. While the plug can be made from any material, rigid, sharp, or heavy plugs are not desirable because they could become dangerous missiles when propelled from the muzzle.

Because the loads of the invention need not be handled in a conventional mechanical firearm (as is the case with a standard blank cartridge), the loads are inexpensively manufactured and contain far less powder than a conventional blank cartridge. In addition, because the loads are mounted in the front of the gun near the end of the barrel, the flash and smoke emanate from very close to the barrel exit and much less powder is required to achieve the desired effect. Typically, depending on the desired effect the quantity of powder used in each load is less than 2.0 grains, preferably less than about 1.5 grains, and more preferably from about 0.25–1.25 grains. Smaller loads of about 0.25–0.5 grains are used for close shots in which very little noise is desired. Larger loads of about 1.0–1.5 grains are used when more fire and noise is desired, such as for a machine gun.

Since the cartridge need not be handled by the feed or ejection mechanisms of a gun, no structural limitation (e.g. brass cartridge exterior) or weight, size, or shape limitations are imposed. The loads remain in the same position in the gun before, during, and after usage.

Figure 4:
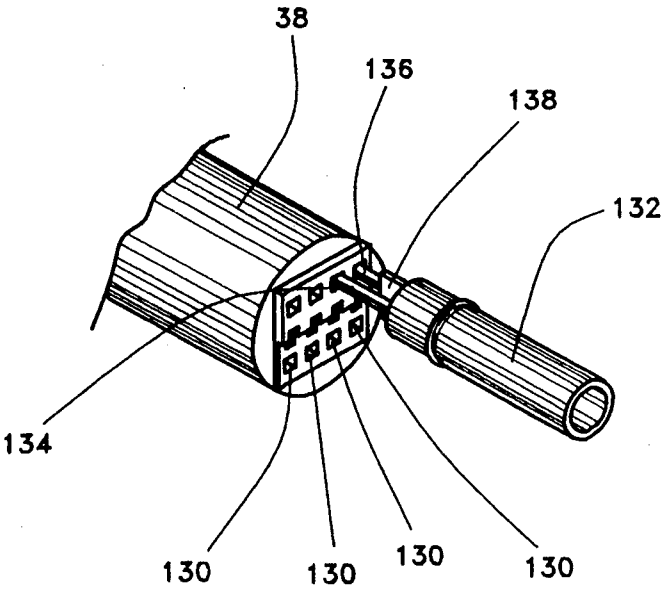
FIG. 4 is a partial view showing a squib or load mounted into the muzzle socket.

The loads of the invention are mounted in the muzzle portion of the gun as shown in FIG. 1 and 4. To insert or replace the loads, the muzzle portion of the pistol housing 8 is removed by first removing screw 24 and sliding the muzzle away from the socket 38. Spent loads are removed by pulling the pins from the socket, and fresh squibs are mounted in the socket by inserting the terminals in pinholes in the socket. As shown in FIG. 4, load 132 having terminals 134 and 136 spaced by insulator tab 138 are mounted in pinholes 130 in the socket. Operation of the simulated gun is extremely simple; the loads are inserted in the socket, the muzzle is replaced, the toggle switch is turned to the "on" position, and the trigger is pulled. Each time the trigger is pulled one squib is fired, until all squibs have been used up.

Figure 3:
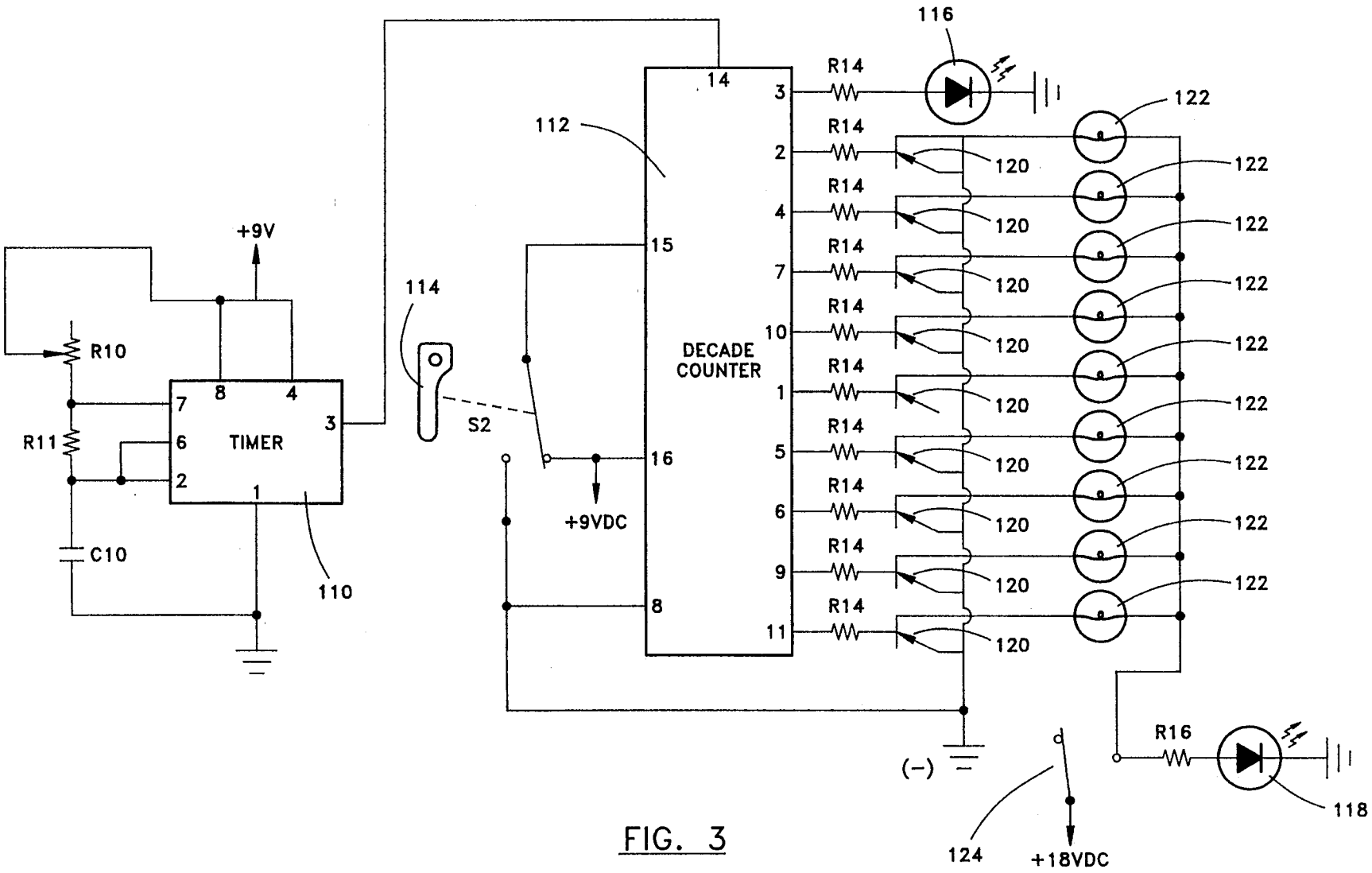
FIG. 3 is a schematic diagram of a simulated machine gun built according to the invention.

The same system of the invention is adaptable to any type of single fire or rapid action simulated firearm. FIG. 3 shows a circuit diagram for use in a simulated automatic machine gun having nine loads 122 which are fired sequentially. Timer 110 is the same I.C. 555 chip as described previously; in this case, it is connected to operate as an astable multivibrator which emits about six pulses/second until all shots are fired. The speed of the pulses can be varied by means of one megohm potentiometer $R_{10}$; proper simulation generally requires at least about 4 pulses per second, preferably 6–8 pulses/-second. When trigger 114 is depressed, it actuates SPDT switch $S_2$ which moves from NC to open. Pulses are sequenced by the decade counter I.C. 4017 in correspondence to each square wave pulse received from the timer. Thus, the shots will fire continuously until the trigger is released or all of the shots have been spent. As previously indicated, a simulated machine gun may be of any shape, whether realistic or futuristic, and may have one, several, or many "muzzles" or sockets in which loads are mounted prior to discharge.

The red LED 118 is connected to the voltage source through an on/off toggle switch 124 in the same manner as in the simulated pistol of FIG. 2. The optional safety green LED 116 similarly indicates that the counter has been reset to zero and that the loads can be safely reinserted. In this case, when the trigger is released, the counter resets automatically and fires again when the trigger is pressed.

Component values for the electronic components of the machine gun circuitry shown in FIG. 3 are as follows: $R_{10}$ potentiometer=1 megohm; $R_{11}$=10K ohms; $R_{12}$, $R_{14}$, and $R_{16}$=2K ohms; and $C_{10}$=0.47 $\mu$fd. The timer, decade counter, and Darlington transistors 120 are the same components as are shown and described for FIG. 2.

While the machine gun electronics have been shown in FIG. 3 to handle nine squibs, multiplexing is easily accomplished by additional I.C. 4017 counter chips. One of the outputs on the chip can be used to transfer pulses to the next chip indefinitely, thus providing the opportunity for an unlimited number of shots to be fired.

Even though the squibs, which have less than one grain of powder each, will show a highly visible flash or "fireball" on detonation, the simulated guns of the invention are essentially harmless. Whereas normal blank guns, which frequently have 10–30 grains of powder in each shot, can cause serious injury or even kill a person, the discharge of the squibs described herein has virtually no impact a few feet away. In fact, by drilling a hole on the periphery of the muzzle which allows the discharge from the squib to come out the side of the gun, an actor can put a pistol to the body of a "victim" and the discharge will harmlessly exit the side of the muzzle.

Figure 6:
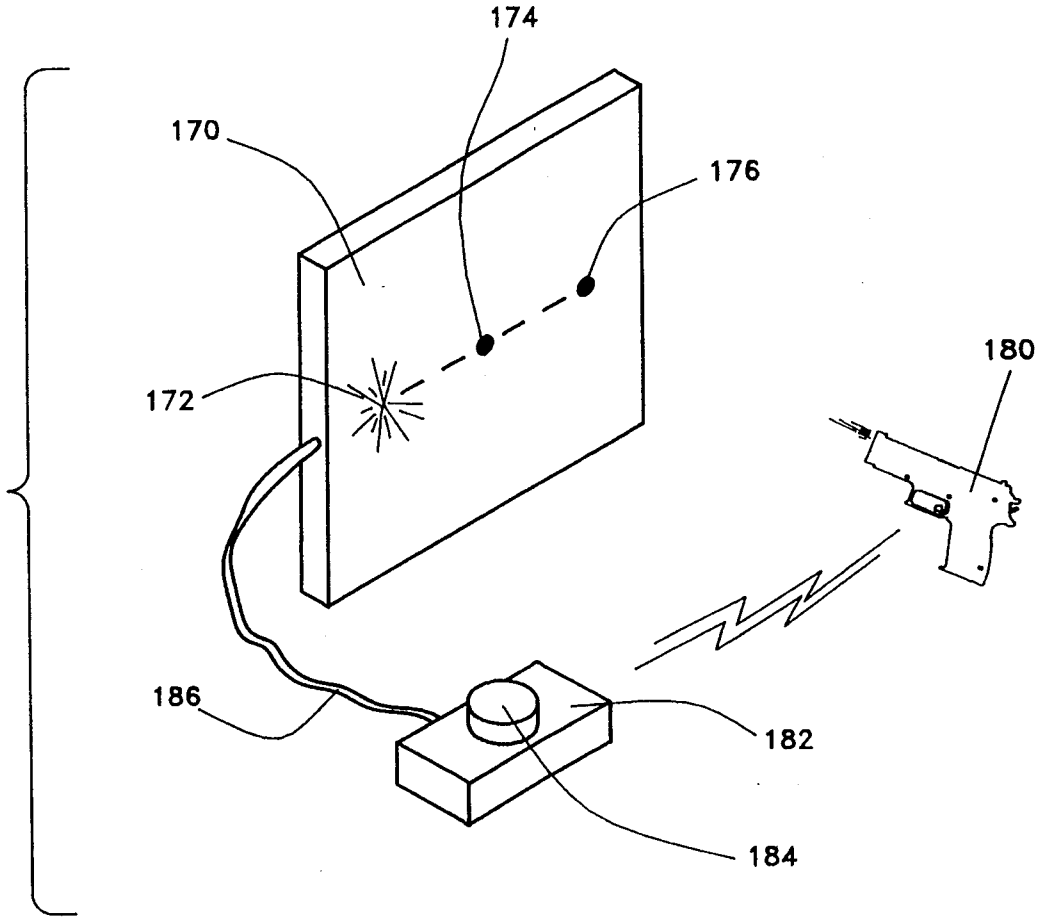
FIG. 6 illustrates substantially simultaneous remotely controlled firing of a gun and exploding of a bullet hit on a wall.

The simulated guns of the invention are particularly useful in permitting synchronization of gunshots with simulated bullet impacts which are charges that are placed in walls, glasses, bottles, clothing and the like. Because both the gun and the charges can be actuated electronically, the flash of the gun and the "impact" can be perfectly synchronized by either hardwiring from the gun to the impact charges or by sending a remote signal simultaneously to the gun and to the charges. An example of remote actuation is shown in FIG. 6. Charges 172, 174, and 176 are mounted behind wall 170 and are wired through conduit 186 to a remote activating source 182.

The activating source can be any power source operated by switch 184, similar to a conventional garage door opener or TV remote control. When the actuating switch button 184 is pushed, pulses are sent simultaneously to the simulated gun 180 and to the explosive charges, allowing for perfect visual synchronization of the simulated gun shots with the explosions representing the impact of the shots on the wall. If desired, a slight time delay can be built into the circuitry. As shown, a small receiver can be placed in the gun to receive the radio pulses from the remote actuator; the impact discharges may also be connected by hardwire or by a remote receiver. If desired, a transmitter can be mounted directly in the gun such that pulling the trigger fires the shots from the gun and detonates the explosive "hit" charges. Remote detonations and actuations can be effected by any known means, including hardwiring, radio or optical transmissions, or the like.

Remote actuation of the gun and simulated shots are required in a number of filming situations. When a camera is mounted on a moving vehicle, boat, or airplane which photographs over the top of the firing weapon, the director can fire the weapon on cue when the action taking place is correct and properly staged. The actor holding the gun will not be in position to determine the proper time for filing, since he cannot tell if the camera is in the correct position. If the actor fires at the wrong time, the camera could miss either the shooting or the explosion of the gun hits. Using the system of the invention, the director activates both the gun and the gun hits when the scene is ready.

Other filming opportunities also are created by the system of the invention. For example, if a scene calls for an actor to be shot through a plate glass window, a camera can be located behind the actor and can film the gun shot, the glass shattering, and the actor being hit simultaneously. Similarly, a camera could be located behind a gun which fires through the window of a moving car. Or, if a scene calls for an actor to be shot while in water, with bullet hits going off in the water, cameras could be located both behind the gun and the actor to shoot the scene simultaneously from both angles.

In general, if the gun is stationary in a scene, the gun can be hardwired to the hits. The pulse generated by the gun detonates both the squib and the bullet impacts. If the gun is moving, actuation is easiest by radio.

Numerous variations of methods of transmitting and implementing uses of the invention will be apparent to those skilled in the art. The system as shown in FIG. 6 enables a cameraman to shoot both the discharge of the gun and the "impact" in one shooting, obviating the expensive editing which is currently required for this type of scene. In addition, this system permits actuation of the firearm and the shots from an off-scene location by a trained professional, eliminating the frequent miscues caused by untrained actors.

The invention has been described with respect to a preferred embodiment thereof, but should not be considered limited by the specific embodiments disclosed therein. Those skilled in the art will recognize that the electronic simulated detonation system of the invention may be used in various embodiments and for various effects; accordingly, the invention should not be limited by the foregoing description but rather should be defined only by the following claims.

I claim:

1. A combustible load for a simulated firearm comprising, a casing having walls, a hollow interior, and an open end, a plurality of electrically conductive pins extending from the casing for mounting in the simulated firearm, a combustible charge contained within the casing comprising less than 2.0 grains of a finely divided mixture of an oxidizer, a fuel, and a yellow color enhancer, and a resistance wire connected to the pins located inside the casing for igniting the combustible charge.

2. The load of claim 1 wherein the combustible charge comprises less than about 1.5 grains of powder.

3. The combustible load of claim 1 wherein the charge comprises from about 0.25–1.25 grains of powder.

4. The combustible load of claim 1 wherein the fuel is powdered magnesium.

5. The combustible load of claim 1 wherein the oxidizer is potassium perchlorate.

6. The combustible load of claim 1 wherein the color enhancer is sodium oxalate.

7. The combustible load of claim 1 wherein the fuel is magnesium and the oxidizer is potassium perchlorate.

8. The combustible load of claim 1 wherein the combustible charge comprises from about 35% to about 55% by volume of magnesium powder, from about 5% to about 15% by volume of sodium oxalate, and less than 50% by volume of an oxidizer.

9. The combustible load of claim 1 also comprising plug means to maintain the powder in place within the combustible load.

10. The combustible load of claim 9 wherein the plug means comprises foamed plastic.

11. The combustible load of claim 1 having a plastic casing having a ratio of length to outside cross-sectional area in the range of from about 15 to about 40 in./sq. in.

12. A combustible load for a simulated firearm comprising, a plastic casing having walls, a hollow interior, and an open end, a pair of electrically conductive pins extending from the casing for mounting in the simulated firearm, a combustible charge containing less than 2.0 grains of a powder mixture which passes a 200 mesh screen, said mixture containing a combustible metal, an oxidizer, and a yellow color enhancer, the casing having a length to outside cross-sectional area in the range of from about 15 to about 40 in./sq. in., and ignition means connected to the pins located inside the casing for igniting the combustible charge.

13. The combustible load of claim 12 having a length of from about 0.5 inch–1.5 inches.

14. The combustible load of claim 12 wherein the casing has an outside diameter of less than 0.4 inches.

15. The combustible load of claim 12 wherein the casing has an inside diameter of less than 0.3 inches.

16. The combustible load of claim 12 wherein the combustible charge comprises less than 1.5 grains of a combustible charge.

17. The combustible load of claim 12 wherein the casing contains from about 0.25–1.25 grains of combustible charge.

18. The combustible load of claim 12 wherein the casing contains from about 0.25–0.5 grains of combustible charge.

19. A combustible load for a simulated firearm comprising, a plastic casing having walls, hollow interior, and an open end, a pair of electrically conductive pins extending axially from the casing for mounting in a socket portion of the simulated firearm, a combustible charge contained within the casing comprising a powder, passable through a 200 mesh screen, comprising less than 2.0 grains of a mixture of magnesium, potassium perchlorate, and a yellow color enhancer, ignition means for igniting the combustible charge comprising a resistance wire connected to the pins located within the casing, and sealing means for retaining the combustible charge within the casing comprising a foamed plastic disk.

20. In combination, a simulated firearm comprising a housing, mounting means within the housing for simultaneously retaining a plurality of explosive loads, and electronic circuit means for providing an electrical charge sequentially to each load, and a plurality of combustible loads mounted in the mounting means, each load comprising a casing having walls, a hollow interior, and an open end, a plurality of electrically conductive pins extending from the casing for mounting in the simulated firearm, a combustible charge contained within the casing comprising less than 2.0 grains of a finely divided mixture of an oxidizer, a fuel, and a yellow color enhancer, and a resistance wire connected to the pins located inside the casing for igniting the combustible charge.

21. The combination of claim 20 wherein the combustible charge comprises less than about 1.5 grains of powder.

22. The combination of claim 20 wherein the charge comprises from about 0.25–1.25 grains of powder.

23. The combination of claim 20 wherein the fuel is powdered magnesium.

24. The combination of claim 20 wherein the oxidizer is potassium perchlorate.

25. The combination of claim 20 wherein the color enhancer is sodium oxalate.

26. The combination of claim 20 wherein the fuel is magnesium and the oxidizer is potassium perchlorate.

27. The combination of claim 20 wherein the combustible charge comprises from about 35% to about 55% by volume of magnesium powder, from about 5% to about 15% by volume of sodium oxalate, and less than 50% by volume of an oxidizer.

28. The combination of claim 20 also comprising plug means to maintain the powder in place within the combustible load.

29. The combination of claim 20 wherein the plug means comprises foamed plastic.

30. The combination of claim 20 having a plastic casing having a ratio of length to outside cross-sectional area in the range of from about 15 to about 40 in./sq.in.

* * * * *